US005423714A

United States Patent [19]

Lach

[11] Patent Number: 5,423,714

[45] Date of Patent: Jun. 13, 1995

[54] PROCESS FOR THE MANUFACTURE OF DIAMOND JEWELLERY

[76] Inventor: Horst Lach, Dammstr. 5, 6450 Hanau, Germany

[21] Appl. No.: 70,975

[22] Filed: Jun. 4, 1993

[30] Foreign Application Priority Data

Jun. 4, 1992 [DE] Germany ..... 42 18 412.6

[51] Int. Cl.[6] ..... B24B 1/00

[52] U.S. Cl. ..... 451/57; 451/540; 63/32; 125/30.01

[58] Field of Search ..... 125/30.01; 63/32, 26, 63/DIG. 3, 15, 2; 51/204, 326; 451/540, 57; 407/118; 175/434, 405.1, 420.2

[56] References Cited

U.S. PATENT DOCUMENTS

| | | | |
|---|---|---|---|
| 286,023 | 10/1883 | Lancon | 63/32 |
| 3,835,665 | 9/1974 | Kitchel | 63/32 |
| 4,809,417 | 3/1989 | Normann, Jr. | 29/160.6 |
| 5,054,246 | 10/1991 | Phaal et al. | 51/204 |

FOREIGN PATENT DOCUMENTS

| | | | |
|---|---|---|---|
| 0133386 | 2/1985 | European Pat. Off. | 63/32 |
| 649990 | 9/1928 | France . | |
| 2152412 | 4/1973 | Germany . | |
| 2444705 | 9/1974 | Germany . | |
| 2702176 | 1/1977 | Germany . | |
| 2912681 | 4/1989 | Germany . | |
| 22759 | 4/1973 | Luxembourg . | |

*Primary Examiner*—Robert A. Rose
*Attorney, Agent, or Firm*—Larson & Taylor

[57] ABSTRACT

The process serves for the manufacture of diamond jewellery. In order to be able to offer diamonds of individually varying outward appearance and the everlasting advantage of scratch-resistant surfaces it is provided according to the invention to burn depressions into a ground polycrystalline diamond by means of a laser beam and to subsequently vapor-deposit a layer thereon which by regrinding the ground surface is removed from the surface yet maintained within the depressions.

5 Claims, 1 Drawing Sheet

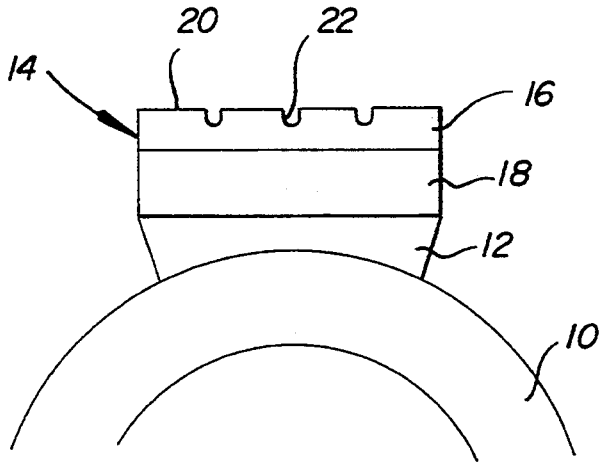
20
22
14
16
18
12
10

PROCESS FOR THE MANUFACTURE OF DIAMOND JEWELLERY

The present invention is concerned with a process for the manufacture of diamond jewellery and bijouterie produced in accordance with this process.

Diamond is the hardest material, and diamond jewellery because of the cost-intensive manufacture involved therewith is particularly precious, distinguishing itself from other jewels by its optical properties and by the fact that the ground surfaces polished by super-fine grinding thanks to the hardness of the material despite unavoidable frictional contacts with other articles maintain their shining brilliance and reflecting effect without getting dull, scratched and unattractive in the course of the time.

Diamonds used for manufacturing jewels, normally, are only ground and set. Although a variety of diamond cuts are known of which the brillant is the most famous, the strong desire for individually shaping and adjusting jewels to other trends and fashions is satisfied inadequately. Only the setting in the form of brooches, rings etc. rather than the diamond itself forming the essential part of the jewel is adaptable to the desired extent.

It is, therefore, the object of the present invention to substantially extend the capabilities of variation of diamond jewels while using the advantageous properties of permanently intact and hard surfaces. This problem in accordance with the invention is solved in that a polycrystalline diamond is ground, depressions are burnt into a ground surface by means of a laser beam, the depressions are cleared from combustion residues, a coating is deposited on the ground surface provided with depressions and, finally, the ground surface is reground, with the coating being removed.

While, hitherto, only the outer shapings of diamonds used as jewels, have been varied by different angles and sizes of the ground surfaces, the present invention has opened to diamond jewelery a completely new perspective of artistic design capabilities, namely contrasting ornamentation of any desired intensity of individual planar surfaces. The graphical presentation takes advantage of the contrast between the black colour of polycrystalline diamond and the multiplicity of available bright coatings consisting of noble metals, coloured metal oxides or other vapor-depositable materials. As the coating has become embedded within the depressions and as the depressions generated by means of a laser beam can be very narrow, the comparatively soft coating material is protected against outward attack caused by mechanical friction whereas the ground surfaces of the polycrystalline diamond projecting outwardly in view of the extreme hardness of the diamond maintain their reflecting brilliance over an extended period of time unscored and generally undamaged.

BRIEF DESCRIPTION OF THE DRAWING

The drawing show a polycrystalline jewel diamond attached to a ring and produced in accordance with the process of the invention.

The ring 10 is only indicated in the drawing. It is formed with a base 12 to which is soldered a gemstone, with the latter being formed of layers, i.e. an upper layer 16 of polycrystalline diamond and a lower layer 18 of head metal connected thereto. Polycrystalline diamonds, normally, are made available by manufacturers in this dual-layer combination with hard metal because the bottom layer of hard metal can more easily be connected by soldering to other materials than is the polycrystalline diamond. However, the invention is not restricted to jewel diamonds of such a dual-layer design, for polycrystalline diamonds in vacuum can also be soldered directly onto a suitable substrate or can be set the same way as other gemstones.

In the embodiment shown the polycrystalline diamond 16 is ground only on the upper side thereof to form a single planar surface 20. To give the surface a graphical design after grinding depressions 22 have been burnt into the surface 20 by means of a laser beam. For this purpose, an inscription laser manufactured by Haas Laser GmbH of D-7230 Schraumberg, is suitably employed. Depending on the diameter of the laser beam the width of the depressions 22 can be reduced to e.g. 50 or 30 $\mu$ enabling also very narrow lines to be well visible in colour against a black background. Basically, depressions of any desired width can be produced by means of the laser beam and also the depth thereof can be randomly selected. A depth of 15$\mu$ has already proved to be adequate which, however, individually can be readily enlarged. Further, the depth of the depressions 22 can be graded or contoured.

When the laser beam burns the polycrystalline diamond 16 in the depressions 22 ashes are left which can be mechanically brushed off and, optionally, are additionally removed in a cleansing bath through ultrasonic means.

In the further course of the manufacture, a coating of material of different colour is vapor-deposited onto the ground polycrystalline diamond 14 provided with depressions. Individually, for example, a chromium-nickel layer can be initally vapor-deposited as an adhesive coating followed by a coating of gold, platinum or palladium upon which a protective coating of silicon oxide is finally evaporated.

The coatings are very thin. A gold coating requires a thickness of as little as 50 nanometer. The coating is effected in the PVD process by means of a so-called electronic beam gun. Evaporators of that type are commercially offered by Leybold AG, of D-6450 Hanau.

During the coating process, the entire surface 20, inclusive of depressions 22, is covered by the coating material. By again slightly regrinding surface 20, the coating material is removed from this surface but is left within the depressions 22 so that the coloured depressions are clearly distinguished from the planar smoothly polished black surface 20. In view of the hardness of the material, the said surface remains unscratched for a long time while the coloured coating as a result of the protected position within the depressions 22 is permanently maintained.

It is readily understandable that the polycrystalline diamond can exhibit a plurality of planar and/or curved surfaces one or several of which can be provided with depressions. Shape and position of the various surfaces and depressions 22 and also the process for manufacturing the polycrystalline, diamond are of no relevance to the invention, In all cases one arrives at extremely hard projecting surfaces of polycrystalline diamond and sunk-in protected surfaces of different colour which are in contrast to the reflecting dark outer surface 20.

Moreover, it is understood that, for example, by partially masking individual depressions 22 and vapor-depositing different substances also multi-coloured designs are obtainable. Further modifications include different procedures of depositing a coloured layer e.g.

dipping the diamond into a liquid colorant or lacquer or using a paint brush.

I claim:

1. A process for the manufacture of diamond jewelry comprising grinding a polycrystalline diamond surface, burning the ground surface by means of a laser beam to provide an outer surface containing depressions therein, clearing the depressions of combustion residues, depositing a coating onto the ground surface and said depressions, regrinding said ground surface to remove the coating from said outer surface but not from said depressions.

2. A process according to claim 1 wherein the coating is vapor-deposited onto the ground surface.

3. Diamond jewelry comprising a polycrystalline diamond having a ground surface with depressions formed therein and a coating provided only in said depressions.

4. Diamond jewelry according to claim 3 wherein the depressions have a depth of between about 15 and 30$\mu$.

5. Diamond jewelry according to claim 3, Wherein the coating has a thickness of less than 1$\mu$.

* * * * *